US011958669B1

(12) United States Patent
Joseph

(10) Patent No.: US 11,958,669 B1
(45) Date of Patent: Apr. 16, 2024

(54) SANITIZABLE STRAP ASSEMBLY

(71) Applicant: John Joseph, Sacramento, CA (US)

(72) Inventor: John Joseph, Sacramento, CA (US)

( * ) Notice: Subject to any disclaimer, the term of this patent is extended or adjusted under 35 U.S.C. 154(b) by 0 days.

(21) Appl. No.: 18/111,867

(22) Filed: Feb. 20, 2023

(51) Int. Cl.
*B65D 63/10* (2006.01)

(52) U.S. Cl.
CPC ..... *B65D 63/1018* (2013.01)

(58) Field of Classification Search
CPC ... B65D 63/1018; Y10T 24/1498; F16L 3/233
See application file for complete search history.

(56) References Cited

U.S. PATENT DOCUMENTS 3,835,505 A * 9/1974 Shewbridge ..... B65D 63/1027 24/339
D370,407 S * 6/1996 Pietrowski ..... D8/394
6,401,305 B1 * 6/2002 Joseph ..... F16L 3/233 24/17 AP
6,523,229 B2 * 2/2003 Severson ..... B65D 63/1018 24/16 PB
6,634,063 B2 * 10/2003 Joseph ..... F16L 3/233 24/17 AP
2010/0133401 A1 * 6/2010 Joseph ..... E05C 19/184 248/231.91
2018/0073677 A1 * 3/2018 Joseph ..... F16M 13/02

FOREIGN PATENT DOCUMENTS

WO WO-2012155372 A1 * 11/2012 ..... B65D 63/1018

* cited by examiner

*Primary Examiner* — Robert Sandy
*Assistant Examiner* — Louis A Mercado
(74) *Attorney, Agent, or Firm* — Alfred F. Hoyte, Jr.

(57) ABSTRACT

A strap assembly for cable and cord management in sterile environments is provided. The assembly includes a strap and a fastener. The fastener and relatively flat strap are characterized by a minimum of bacteria harboring surface features, and are made from easily sanitizable materials. The strap is discretely adjustable lengthwise via a plurality of apertures formed therein. A first group of apertures are used to attach to the cord and a second group of apertures allows for positioning the strap about a cord bundle, the fastener interacting with said apertures to secure the strap to the bundle. Necessary surface features on the strap such as indicia are limited to a predetermined height to ensure that a single pass with a sanitizing wipe can effect bacterial and viral decontamination.

4 Claims, 3 Drawing Sheets

SANITIZABLE STRAP ASSEMBLY

FIELD OF THE INVENTION

The present invention is related to straps used for bundling. More particularly, the invention is related to straps for bundling cables in a sanitized environment.

BACKGROUND OF THE INVENTION

Straps are used for various purposes in hospitals and medical settings and have an impact on the quality of patient care. Medical personnel must use straps to secure patients so that they do not fall off of procedure tables, gurneys, or stretchers in treatment areas. Straps are also used to position a patient for treatment; for instance, for holding an arm securely in place for receipt of an intravenous needle during surgery. Straps must be securable by medical personnel and effectively hold a patient in place on a gurney, a table, in a chair, or the like.

Since the introduction of microprocessor driven medical technology, there is much cabling used to interconnect smart devices, displays, and other computerized medical equipment. In order to minimize the space required to route these cables, they are often bundled by straps. However, when sterilizing e.g., an operating room, care must be taken to sterilize everything in the room including the cables and associated bundling straps. Conventional straps are characterized by buckles, fabrics that form sharp edges, and rough or porous fabric. Moreover, conventional straps often have buckles or other fasteners such as Velcro® with surfaces and shapes that resist sterilization and cannot be easily sanitized. Further, the materials of the straps themselves typically resist sanitization. Thus the spread of infections through a hospital, which is a common problem, may be aggravated by conventional straps. Velcro® is particularly problematic as it attracts random debris and provides a very large effective surface area for the growth and harboring of pathogens.

Many types of cable ties or straps are known in the art ranging from the simple wire twist to fairly complicated devices requiring special tools for implementation. The simpler mechanisms, e.g., multiple notch strap with integral locking head, suffer from the drawback in that they are not capable of repeated use without failure, or are incapable of retaining heavy or bulky cables effectively. The more complex mechanisms, in addition to often requiring special tools, e.g., for tightening about the cable, are subject to failure. Since non-standard parts are usually used with these ties, replacement of damaged or lost parts is usually not possible.

U.S. Pat. No. 5,367,749 issued to Takeuchi discloses a cable tie having a typical apparatus of lock portion and band portion. The band portion is permanently attached to the lock portion, with the band having a series of regularly spaced sawtooth indentations which cooperate with a sawtooth locking projection formed inside the lock portion. By contrast, the present invention concerns a cable tie apparatus having a separate strap and locking portion.

U.S. Pat. No. 4,993,669 issued to Dyer discloses a cable tie apparatus with a separate tie head and strap. The tie head has a pair of slots for receiving opposing ends of the strap, with a locking means formed within the slots in order to securely retain the strap. The present invention contemplates a cable tie apparatus having a tie head and a separate strap. The tie head retains the strap at three locations, thereby allowing the tie head and strap to remain attached to the cable when the cable is unbundled.

U.S. Pat. No. 4,149,298 issued to Forest discloses a tie member for mounting a cable to a chain link fence. The device has means for securely clamping to a single wire of the chain link fence and the cable to be attached to the fence. By contrast, the present invention is a cable tie apparatus having a tie head adapted for retaining a strap securely about a single loop of a bundled cable, while retaining the remaining portion of the strap about the other loops of the cable in order to secure the bundle.

SUMMARY OF THE INVENTION

A strap assembly for cable and cord management in sterile environments is provided. The assembly includes a strap and a fastener. The fastener and relatively flat strap are characterized by a minimum of bacteria harboring surface features, and are made from easily sanitizable materials.

The strap is discretely adjustable lengthwise via a plurality of apertures formed therein. A first group of apertures are used to attach to the cord and a second group of apertures allows for positioning the strap about a cord bundle, the fastener interacting with said apertures to secure the strap to the bundle. Necessary surface features on the strap such as indicia are limited to a predetermined height to ensure that a single pass with a sanitizing wipe can effect bacterial and viral decontamination.

DETAILED DESCRIPTION OF THE PREFERRED EMBODIMENTS

Figure 1:
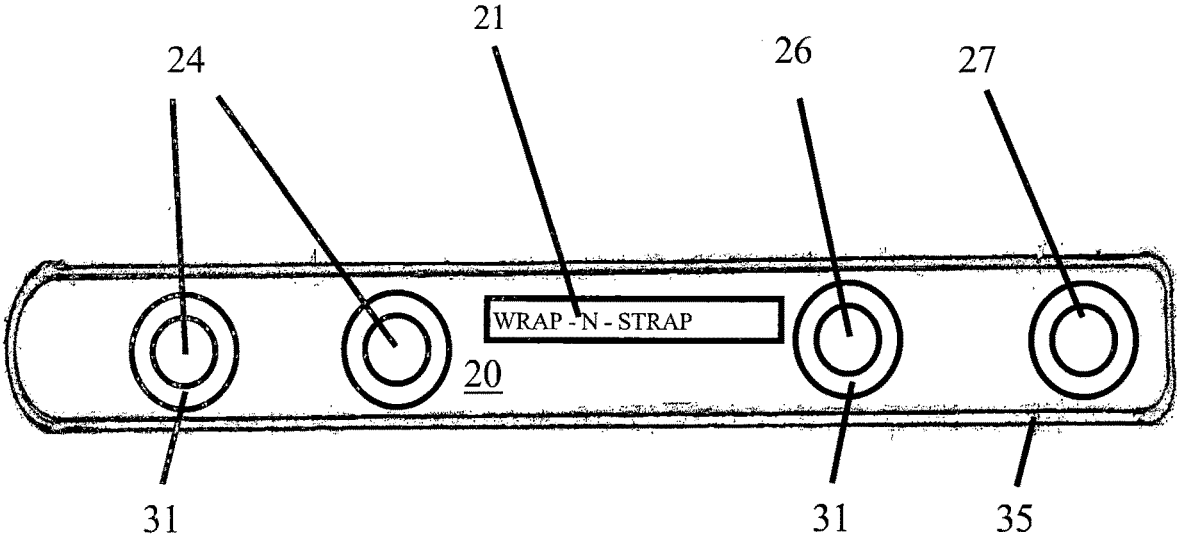
FIG. 1 shows a plan view of the strap of the assembly.
Figure 2:
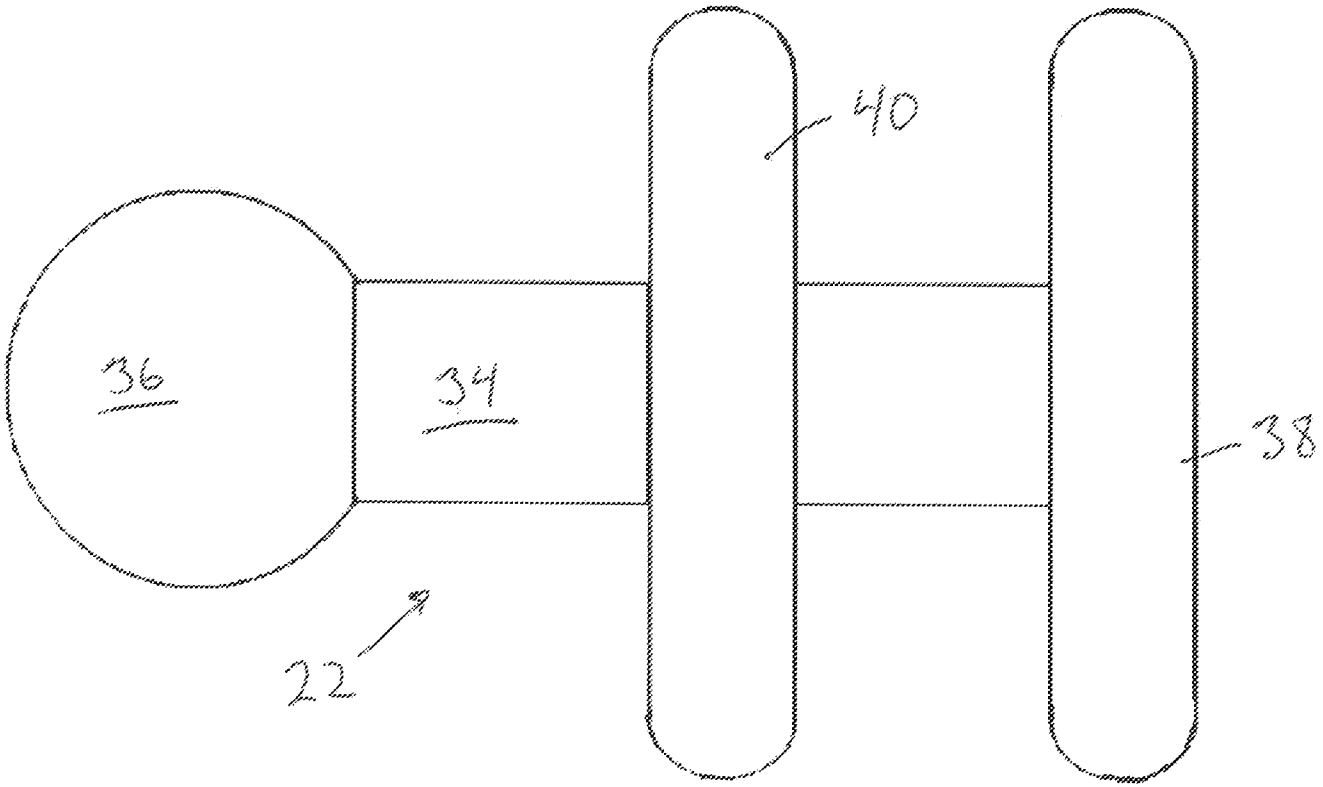
FIG. 2 shows a side view of the fastener.

The present invention is directed to a sanitizable strap assembly. The assembly, generally indicated by the numeral 10, is designed for use in sterile environments such as operating rooms or clean rooms for semiconductor processing. A key feature of the assembly 10 is that both components of the assembly 10 are made from smooth, non-porous materials with limited raised surface features, which features tend to harbor bacteria and other harmful pathogens.

Referring now to FIGS. 1-6, the assembly 10 includes a strap portion 20 and a fastener 22. The strap 20 portion of the assembly is preferably made of rubber or other non-porous, non-allergenic elastic material. Preferred material for the strap 20 includes EPDM®, silicone, or similar flexible rubber like material, which material must be capable of being sterilized in a autoclave (sterilizer) which produces steam at a high temperature. Straps 20 can be made from various rubber products that will withstand the medical requirements of RoHS3, Reach 224, and Prop 65. In accordance with the invention, during sterilization procedures, the strap 20 can be sanitized by autoclaving, laundering, or chemical treatments of various medically authorized chemicals for anti-microbial disinfection.

Figure 3:
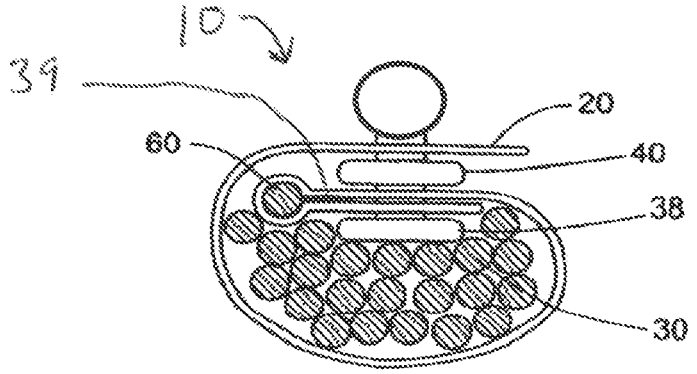
FIG. 3 shows a cross section of the assembly secured about a cord.
Figure 6:
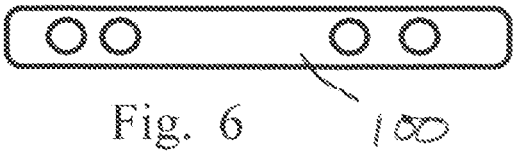
FIG. 6 shows a plan view of another alternative embodiment for the strap of the assembly.

Regardless of material, straps 20 can be created in many different colors, which may be used for color-coding where, e.g., each size has a distinctive color, allowing for determining at a glance the size or function (intended use) of the strap. Two groups of apertures 24, 26 are formed extending from the opposing ends of the strap 20. A separate aperture 27 serves to capture a single loop of cable 30 so as to secure the assembly to the cable. The first group of apertures 24 allow for adjustably securing the strap 20 about the cable bundle 30 to prevent the unraveling thereof. It can be appreciated that the assembly 10 can be used to bundle or store a single cord fashioned as a bundle 30 (or otherwise configured for compact storage) as shown in FIG. 3, or may be used to assist in the orderly routing of several cables from various devices in, e.g., an operating room environment. As shown in FIGS. 1 and 6, the strap 20 has 4 apertures which is the minimum number of apertures as 3 or fewer apertures would limit lengthwise adjustability of the strap.

In some instances, strap 20 may need to include raised indicia 21. In accordance with one aspect of the invention, if raised indicia is used, it must be limited to a height of 0.1 mm to minimize pathogen harboring surfaces. With indicia at a height of 0.1 mm or less, sanitizing the strap can be easily accomplished with a single pass from, e.g., a disinfecting wipe. Also, if any indicia is on the strap 20, it must be contained to one side, with the flat 23 (non-indicia) side positioned to contact the cord bundle 30. Of course, a strap 100 can be formed with no indicia or raised surface features as shown in FIG. 6, but a strap so formed will have limited durability as discussed below.

The assembly 10 includes a fastener 22 for securing the strap 20 to the cable(s). Like the strap 20, the fastener 22 is made from a smooth non-porous material such as a hard plastic and has essentially no pathogen harboring features. Unlike many fasteners for straps and the like, fastener 22 has no recesses, depressions, Velcro, or indentations and is molded as a single, solid item of unitary construction. The fastener 22 could easily be wiped clean or immersed in a disinfecting fluid. It can be seen that the fastener 22 has a central post 34 that connects opposing ends, which are fashioned as a ball 36 at one end and disc 38 at the opposing end, as well as central disc 40. The ball 36 and disc 38 serve as the locking or latching components of the fastener 22. The disc 38 serves to attach the assembly 10 to the cord 60 and the ball 36 serves to allow for adjusting the tension of the strap 20 when secured about a cord bundle 30 as discussed below. End disc 38 is relatively large compared to ball 36 and, preferably, has the same diameter as central disc 40. The end disc 38 is sized for insertion into and through aperture 27 in the manner of a button, this action serving to lock or latch the strap 20 to the fastener 22. Ball 36 is sized and shaped so as to make fastener 22 easier to engage and disengage from the strap 20, the ball 36 sized for insertion into and through apertures 24. Disc 38 is somewhat more difficult to remove from the strap 20, this being intentional as in common use the strap 20 will be permanently attached to cable 30 as described below. It can be appreciated that even with reinforcing beads (as discussed below) apertures 24, 26, 27 are subject to stresses and deformation with repeated use. Accordingly, the ball 36 allows for facile release and attachment of the fastener 22 to the strap 20 to reduce these stresses and thereby reduce the possibility of material failure. An integral construction may be used to form fastener 22, the fastener 22 preferably being formed of unitary construction, e.g., by molding so as to form a single, solid piece. Any rigid, durable material may be used to form the fastener 22.

In use, the portion of the strap 20 having apertures 26 is folded over to form a loop 39 to capture or attach to a single loop 60 or portion of the cord 30 as seen in FIG. 3, the loop 39 formed between discs 38 and 40. The length or circumference of the loop 39 formed by folding the strap 20 over is equal to the length of strap 20 between apertures 26 and 27, the size of the loop 39 corresponding to the wire gauge of the cord 30. Thus, for large wire gauge cords 30 this length has to be sufficient for the loop 39 to encircle a single diameter (i.e., the wire gauge) of the cord 60. After securing the assembly 10 onto the cord (60), the remaining length of strap 20 is wrapped around the cord 30 as shown in FIG. 3 to secure the bundle or to secure a group of cords at regular intervals such as when routing a number of cables in a room, with ball 36 inserted into and through one of apertures 24, the particular aperture 24 selected to secure strap 20 about bundle 30 with sufficient tension.

As the wire gauge or diameter of cords 30 varies widely, straps of several lengths with correspondingly different spacing between apertures 26, 27 should be provided, with the elasticity of the strap 20 allowing for a range of cord 30 diameters or gauges. As previously mentioned, straps 20 may be color coded in accordance with size or length, with the coding allowing users to choose both strap 20 length and loop 39 length between apertures 26, and 27 at a glance.

Figure 4:
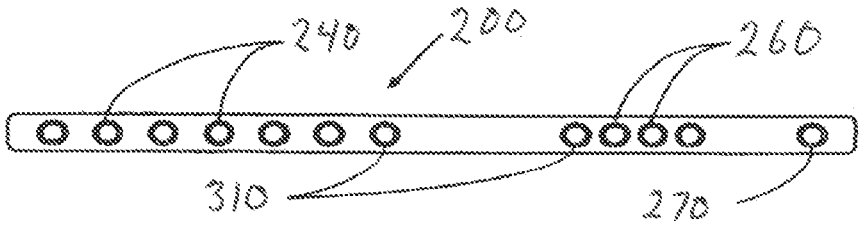
FIG. 4 shows a plan view of an alternative embodiment for the strap of the assembly.

FIG. 4 shows a strap 200 that can be used to accommodate a range of cord 30 diameters and lengths, the strap 200 utilized with a fastener 22 to attach to and bundle the cord 30. Apertures 260 allow for a range of wire gauges, the apertures 260 used with aperture 270 to form a cord capturing loop as described above. Seven apertures 240 allow for length adjustment to accommodate cable bundles of various lengths and in various storage configurations. Strap 200 is configured for use as a general purpose strap and as such has great utility in a sterile environment.

Figure 5:
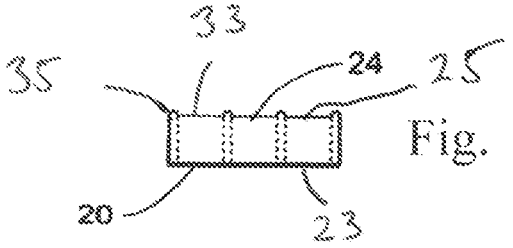
FIG. 5 shows a cross section of the strap illustrating the reinforcement bead.

Referring particularly now to FIGS. 1 and 5 it can be seen that both sets of apertures 24, 26, and aperture 27 include a circumferential reinforcing bead 31 to reduce the possibility of strap 20 failure due to rupturing of the material proximate the aperture. Also, the strap 20 has upper bead 35 formed about its perimeter on the upper side 25 to reinforce the strap 20 and extend the useful life thereof. The upper bead 35 is about 1 mm in height above the upper surface 33 and in addition to providing reinforcement is used to provide a gripping surface or fingerhold so that the user can more easily grasp and stretch the strap 20. Beads 31 are limited in height (relative to the upper surface 33 of the strap 20) to 0.2 mm which is sufficient to provide additional strength without creating pathogen harboring surfaces on the strap 20. The strap may be formed without reinforcing beads 31, 35, 310, but in practice straps without reinforcing beads are subject to failure and have a limited life span. Apertures 26 and 27 may optionally be formed without beads 31, as the strap 20 portions proximate or encircling these apertures are not subject to the same loading and torsional stresses as apertures 24. To ensure that the strap 20 remains securely attached to fastener 22 under high stress conditions, the apertures 24, 26 are substantially smaller than end disc 38 and ball 36. As has been previously mentioned, in the preferred embodiment, apertures 24 allow for securing the strap 20 about the cable bundle 30, while apertures 26 allow for securing the strap 20 about a single loop of the cable bundle 30.

Any variations and any combinations of the above teachings are also intended to be covered by this patent application.

The invention claimed is:

1. A sanitizable strap assembly for securing about a cable formed as a cable bundle comprising:

a strap, said strap having spaced apertures formed therein;

a fastener, said fastener including a pair of mutually opposed first and second locking components, the fastener made from a rigid smooth non-porous material and formed of unitary construction;

said first locking component for securing said assembly to said cable, said second locking component for securing said strap about said cable bundle;

said strap having a top side and an underside, said top side having a top surface and raised surface features and said underside having no surface features, said raised surface features including indicia and a set of reinforcing beads formed about said apertures.

2. The strap assembly of claim 1 wherein said indicia is limited in height to 0.1 mm above said top surface, and said set of reinforcing beads are limited in height to 0.2 mm above said top surface.

3. The strap assembly of claim 2 wherein said raised surface features include a perimeter reinforcing bead positioned about a perimeter of said strap.

4. The strap assembly of claim 3 wherein said reinforcing bead is about 1 mm in height above said top surface.

* * * * *